US009759516B2

(12) United States Patent
Feris

(10) Patent No.: US 9,759,516 B2
(45) Date of Patent: Sep. 12, 2017

(54) SAFETY STORAGE SYSTEM AND METHOD

(71) Applicant: Dee A Feris, Livingston, TX (US)

(72) Inventor: Dee A Feris, Livingston, TX (US)

(73) Assignee: HANGMAN SYSTEMS, LLC, Livingston, TX (US)

( * ) Notice: Subject to any disclaimer, the term of this patent is extended or adjusted under 35 U.S.C. 154(b) by 144 days.

(21) Appl. No.: 13/897,106

(22) Filed: May 17, 2013

(65) Prior Publication Data

US 2014/0284232 A1 Sep. 25, 2014

Related U.S. Application Data

(60) Provisional application No. 61/803,438, filed on Mar. 19, 2013.

(51) Int. Cl.

| | |
|---|---|
| ***B65D 85/00*** | (2006.01) |
| ***F41C 33/06*** | (2006.01) |
| ***A47G 25/14*** | (2006.01) |
| ***E05B 69/00*** | (2006.01) |

(52) U.S. Cl.

CPC ..... *F41C 33/06* (2013.01); *A47G 25/14* (2013.01); *E05B 69/006* (2013.01)

(58) Field of Classification Search

CPC ..... F16B 45/00; B65D 85/18; B65D 85/185; A45C 13/03; A47F 7/02; F41C 33/06; A47G 25/14; E05B 69/006

USPC ..... 206/317, 278, 278.1, 9, 280, 6.1, 284, 206/286, 287, 288, 289; 24/716; 312/245, 204; 70/340, 344, 77, 78, 346, 70/347, 264, 265

See application file for complete search history.

(56) References Cited

U.S. PATENT DOCUMENTS

| | | | | |
|---|---|---|---|---|
| 2,024,442 | A * | 12/1935 | Flocco | 223/85 |
| 3,743,083 | A * | 7/1973 | James | 206/287 |
| 3,930,702 | A * | 1/1976 | Pichowicz | A47B 67/02 206/457 |
| 4,024,997 | A | 5/1977 | Kolpin | |
| 4,782,947 | A | 11/1988 | Sheiman, Sr. | |
| 4,880,089 | A * | 11/1989 | Chombert et al. | 190/18 R |
| 5,957,308 | A | 9/1999 | Zierenberg | |

(Continued)

OTHER PUBLICATIONS

Thomas, S., International Search Report for International Patent Application No. PCT/US2014/027000, ISA/US dated Jul. 17, 2014.

(Continued)

*Primary Examiner* — J. Gregory Pickett
*Assistant Examiner* — Rafael Ortiz
(74) *Attorney, Agent, or Firm* — Sutton McAughan Deaver PLLC

(57) ABSTRACT

A storage system, comprising a body having a cavity therein configured to house one or more items, and an opening defined by the body and a panel configured to mate with the opening and prevent access to the cavity when the panel is in position; a first lock system between the body and the panel and providing a locked condition in which the panel is locked to the body thereby preventing removal of the panel and access to the cavity, an attachment mechanism coupled to one end of the body and configured to suspend the device; and the body configured to be covered by an article of clothing such that if suspended from a clothes rod among other clothes, the body is substantially disguised as an article of clothing.

20 Claims, 10 Drawing Sheets

(56) References Cited

U.S. PATENT DOCUMENTS

| | | | | |
|---|---|---|---|---|
| 6,161,686 | A * | 12/2000 | Simon et al. | 206/6.1 |
| 6,607,085 | B2 | 8/2003 | Pavlic | |
| 6,685,023 | B2 * | 2/2004 | Bleggi et al. | 206/493 |
| 7,389,868 | B2 * | 6/2008 | Lewand et al. | 206/6.1 |
| 2005/0011786 | A1 | 1/2005 | Wood et al. | |
| 2006/0164208 | A1 * | 7/2006 | Schaffzin | G07C 9/00182 340/5.64 |
| 2008/0035523 | A1 | 2/2008 | Lemire | |
| 2008/0203860 | A1 * | 8/2008 | Myers | A47B 81/005 312/204 |
| 2010/0282804 | A1 | 11/2010 | Stimmell, Sr. | |

OTHER PUBLICATIONS

Thomas, S., Written Opinion for International Patent Application No. PCT/US2014/027000, ISA/US, dated Jul. 17, 2014.

www.itstactical.com, 40 Unique Places to Stash Firearms, Jun. 23, 2010, 1 Page.

forum.cralri.com, WTS ~ "Hang N Hide" Locked Pistol Case, Jun. 7, 2009, 1 Page.

www.ar15.com, WTS: Handgun Hang N Hide, Gorilla Rack, Gun Lock . . . , Dec. 1, 2012, 1 Page.

United States Patent and Trademark Office, Registration No. 2,046,835, Mar. 18, 1997, 1 Page.

Moon, K., International Preliminary Report on Patentability for International Patent Application No. PCT/US2014/027000, The International Bureau of WIPO, dated Sep. 22, 2015.

* cited by examiner

SAFETY STORAGE SYSTEM AND METHOD

CROSS REFERENCE TO RELATED APPLICATIONS

This application for patent claims benefit of and priority to U.S. Provisional Application Ser. No. 61/803,438, filed on Mar. 19, 2013, the entire contents of which are incorporated herein by reference for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to systems, devices and methods for storing or containing items, such as weapons and other valuable against unwanted access; and more specifically relate to a disguisable, portable or mobile locker system and method of use.

Description of the Related Art

Art that may or may not be related to my inventions taught herein include the following.

U.S. Pat. No. 4,024,997, entitled "Gun case including means for suspending the gun case from a support" discloses "[a] gun case including means for suspending the gun case from a support in such a manner that the gun case may be conveniently stored. The gun case includes at least one openable loop securely attached thereto and receivable around a support such as a clothes rod or a hanger to permit the gun case to be suspended from the support. The openable loops supporting the gun case are releasably secured by metal snaps, buckles or Velcro straps. The gun case may be provided with a rigid hanger receiving a pair of spaced openable loops and permitting the gun case to be suspended from the rod of a clothes closet. The gun case may also be provided with means for permitting the gun case to be attached to a belt and thereby form a holster and including a resilient bumper secured to the end of the gun case to protect the muzzle of a gun received in the gun case and zipper-like slidable fastener means which permit access to the gun within the gun case such that the gun therein may be easily removed when the gun case is used as a holster.

U.S. Pat. No. 6,607,085, entitled "Closet hiding place" discloses that "[t]he closet hiding place includes a plurality of telescopic channels that can be adjusted relative to each other to extend the length of a wall above a closet door. The channels are either generally rectangular or semicircular with an open top and simulate a duct when installed in a closet. The channels are mounted to the wall by the extension of fasteners through slots along the upper edge of the back wall of each channel. The front and bottom walls are longer than the back wall to enable the channel to sit flush against the wall. The open top enables a user to place items in the channels to obscure the items from the view of unauthorized persons such as thieves or small children."

U.S. Published Patent Application No. 20080203860 A1 entitled "Concealed Firearm Curio Cabinet" discloses "[a] curio cabinet apparatus comprised of: a central portion having a top surface, a first side surface, a second side surface, a bottom surface, and a front surface; at least one optically concealed forming an optically concealed firearm storage compartment."

My inventions disclosed herein are directed to an improved storage system for weapons and other valuables that provides physical security and/or visual security in the form of disguise or camouflage.

BRIEF SUMMARY OF THE INVENTION

Summarized briefly, the inventions taught herein concern a storage system, comprising a body having a cavity therein configured to house one or more items, and an opening defined by the body and providing access to the cavity; a panel configured to mate with the opening and prevent access to the cavity; a first lock system between the body and the panel and providing a locked condition and an unlocked condition in which the panel is not locked to the body thereby allowing access to the cavity; an attachment mechanism coupled to one end of the body and configured to suspend the system; and the body configured to be covered by an article such that if suspended from a clothes rod among other clothes, the body is substantially disguised.

DETAILED DESCRIPTION OF THE INVENTION

Figure 2:
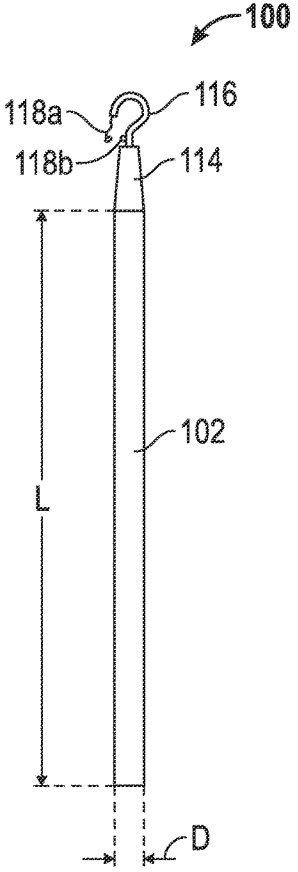
FIG. 2 illustrates a side view of the embodiment in FIG. 1.

The Figures described above and the written description of specific structures and functions below are not presented to limit the scope of what I have invented or the scope of the appended claims. Rather, the Figures and written description are provided to teach a person skilled in the art to make and use the inventions for which I seek patent protection. Those skilled in the art will appreciate that not all features of a commercial embodiment one or of the inventions are described or shown for the sake of clarity and understanding. Persons of skill in this art will also appreciate that the development of an actual commercial embodiment incorporating one or more aspects of the present inventions will require numerous implementation-specific decisions to achieve the developer's ultimate goal for the commercial embodiment. Such implementation-specific decisions may include, and likely are not limited to, compliance with system-related, business-related, government-related and/or other constraints, which may vary by specific implementation, location and from time to time. While a developer's efforts might be complex and time-consuming in an absolute sense, such efforts would be, nevertheless, a routine undertaking for those of skill in this art having benefit of this disclosure.

It must be understood that the inventions taught herein are susceptible to numerous and various modifications and alternative forms. Indeed, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the figures and are not intended to limit the scope of the invention or the appended claims.

As more and more individuals purchase and possess projectile weapons, such and long guns (e.g., rifles, shotguns) and hand guns, and other weapons and valuables; and as more of these weapons and valuables are stored in homes, automobiles and other areas frequented by children, minors, and others untrained in their use, there is a need for an affordable storage system offering at least a threshold of physical security against unauthorized access. In addition, as weapons and other valuables become increasingly restricted or controlled, theft of same, including home break-ins, are expected to increase. There is a need, therefore, for a storage system that not only has a threshold of physical security, but also is not so readily identifiable as a weapon or valuables storage system.

Thus, in general, I have invented a storage system that is affordable, portable and disguisable. The system may comprise a body having one or more cavities therein configured to house or store items that may include long guns, such as rifles and shotguns, handguns, ammunition, jewelry, important papers and other items having value to the storer, or items that pose a risk of harm to others.

Embodiments of my invention may comprise a three-dimensional body, generally, but not necessarily, substantially rectangular in shape and having a thickness of preferably between about 2 and about 5 inches. Of course, the overall 3D shape of the device can be and should be optimized to facilitate the storage of desired items and the disguisabilty of the device. For example, an embodiment can be configured such that an article of clothing, such as a shirt, coat or robe may be hung or draped on the embodiment, much like a clothes hanger. In this way, the device will blend into the other clothes hung in a closet and be relatively hard to discern as a storage system for weapons or valuables.

One portion or end of the device may comprise an attachment component or hook configured to permit the device to be hung from a conventional clothes rod, clothes hook, or other structure that hangs and stores clothing or otherwise can support the embodiment. The attachment component preferably comprises a lock system configured to prevent the embodiment from being removed from were it is hung. Of course, any lock system is only as strong as its weakest link. So, while the embodiment may be locked to, for example, a clothes rod, clothes rod typically may be easily removed from the closet, thereby allowing the storage system to be removed from the rod. Nonetheless, the invention described herein provides a certain measure of physical security from casual access to items stored in the system, or theft of the entire storage system Embodiments may be constructed from a variety of materials and by a variety of methods of construction, including fiberglass, composite materials, polycarbonate (e.g., Lexan) or acrylic (e.g., plexiglass), metal, expanded metal or other such materials that will impart the necessary structural support and security. It will be appreciated that embodiments of the invention likely will not be, and are not required to be, but may be, impenetrable. Rather, embodiments can be constructed to provide impediment or resistance to access, such as by children, teens, and others who should be denied access, yet who are not intent on destroying the storage system to gain access to the items stored in the device. In addition, a portion of the security provided by the storage system resides in disguising the storage system to not resemble a system for storing valuables or weapons.

Embodiments of the invention can be configured and used to securely store a wide variety of items, such as long guns, hand guns, other weapons, jewelry, important papers, money and the like. For example, and without limiting the appended claims, my inventions may comprise a body having a cavity therein configured to house one or more items, and having an opening defined by the body and providing access to the cavity; a panel configured to mate with the opening and prevent access to the cavity when the panel is mated to the opening; a first lock system operable between the body and the panel and establishing a locked condition in which the panel is secured to the body thereby preventing access to the cavity, and an unlocked condition in which the panel is not secured to the body thereby allowing access to the cavity; an attachment mechanism coupled to one end of the body and configured to suspend the body; a second lock system coupled to the attachment mechanism and configured to lock the device to a suspension device to prevent the body from being removed therefrom; and a disguising structure adapted to cover substantially all of the body and panel so that the portions of the body and panel that are covered and those portions that are uncovered visually blend into the surrounding environment.

Figure 1:
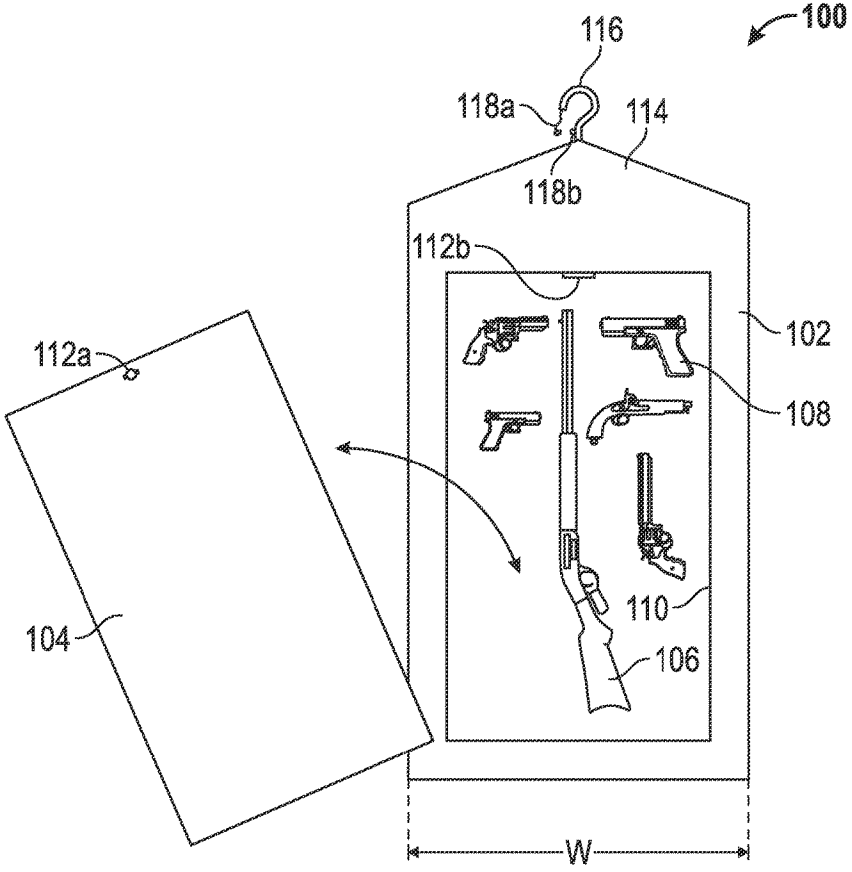
FIG. 1 illustrates one of many possible embodiments of a storage system incorporating aspects of the inventions taught herein.

Turning now to a description of one of many possible embodiments of my invention, FIG. 1 illustrates a storage system 100, comprising a body 102 and an access panel 104. The body 102 may be three-dimensional in that the body encompasses an interior volume in which items may be placed for storage. This volume may also be considered a cavity or storage area. As illustrated in FIG. 1, long guns 106 and hand guns 108 may be placed, stored or secured within the interior volume. As illustrated by FIGS. 1 and 2, the body 102 may have an identifiable width "W", length "L", and depth "D", that defines a length, width and depth (l, w and d) of the interior volume. Those of skill having the benefit of this disclosure will be able to design and construct a storage system of suitable size to store long guns, handguns, jewelry, papers, and other valuables.

Returning to FIG. 1, the body 102 defines an opening 110 that permits access to the interior volume. The size and shape of the opening will be optimized consistent with the size of the interior volume and the type of items to be stored within. The panel or door 104 may be configured to mate with or engage body opening 110 to thereby close off or seal the opening 110. Mating protrusions or recesses may be formed in the body 102 and panel 104 to ensure the panel is securely held in place when locked in the mating condition. Panel 104 and body 102 may comprise a lock system 112 having one or more components. As illustrated in FIG. 1, lock system 112 may comprise a portion 112*a* located on the panel 104 and a portion 112*b* located on the body 102. Together, these portions form lock system 112. Lock system 112 has an unlocked condition in which the panel 104 is not secured or locked to the body 104 and a locked condition in which the panel 104 is secured or locked to the body. It will be appreciated that when the panel 104 is locked to the panel by way of lock system 112, access to the interior volume (and items stored therein) is encumbered. It will be appreciated that lock system 112 may cooperate with other structures on the body 102 and/or on the panel 104 to secure the panel 104 to the body 102 when in the locked condition. Lock system 112 may comprise any of the well-known lock systems available, such as keyed lock systems, combination lock systems, or biometric lock systems.

Figure 3:
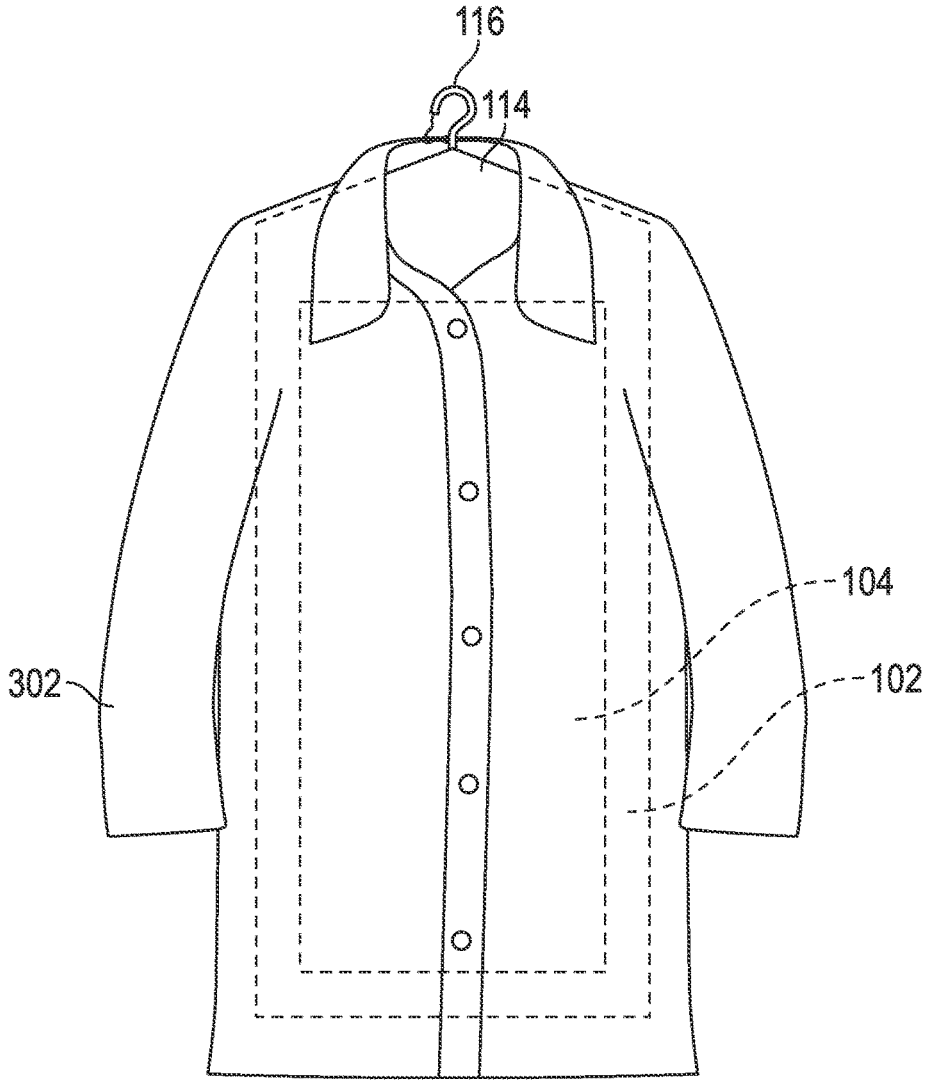
FIG. 3 illustrates disguising an embodiment of a storage system with an article of clothing.

As illustrated in FIGS. 1 and 2, body 102 may comprise a portion 114 that is shaped to more closely resemble hanging clothes when the body is draped with a clothing item 302 as camouflage (See, e.g., FIG. 3). The portion 114 may taper or otherwise change shape in both the width and depth directions as shown, or just the width, or just the depth.

Also illustrated in FIGS. 1 and 2 is an attachment component 116. It is presently preferred that attachment component 116 be configured similarly to a clothes hanger hook for hanging the system 100 from a conventional clothes rod or clothes hook. It is preferred that the attachment component 116 be fabricated from metal or other suitably strong material that resist breakage caused by the weight of the items in the storage system 100 or breakage caused by someone trying to gain unauthorized access to the storage system 100. In addition, the attachment component 116 may comprise one or more flanges or plates for distributing or spreading the weight of the system 100 in the body 102. Attachment component 116 also preferably, but not necessarily comprises a lock system 118 having cooperating elements 118*a* and 118*b*. Lock system 118 is configured to lock storage system 100 to a bar, rod or hook (not shown) from which the storage system 100 is suspended.

Figure 4:
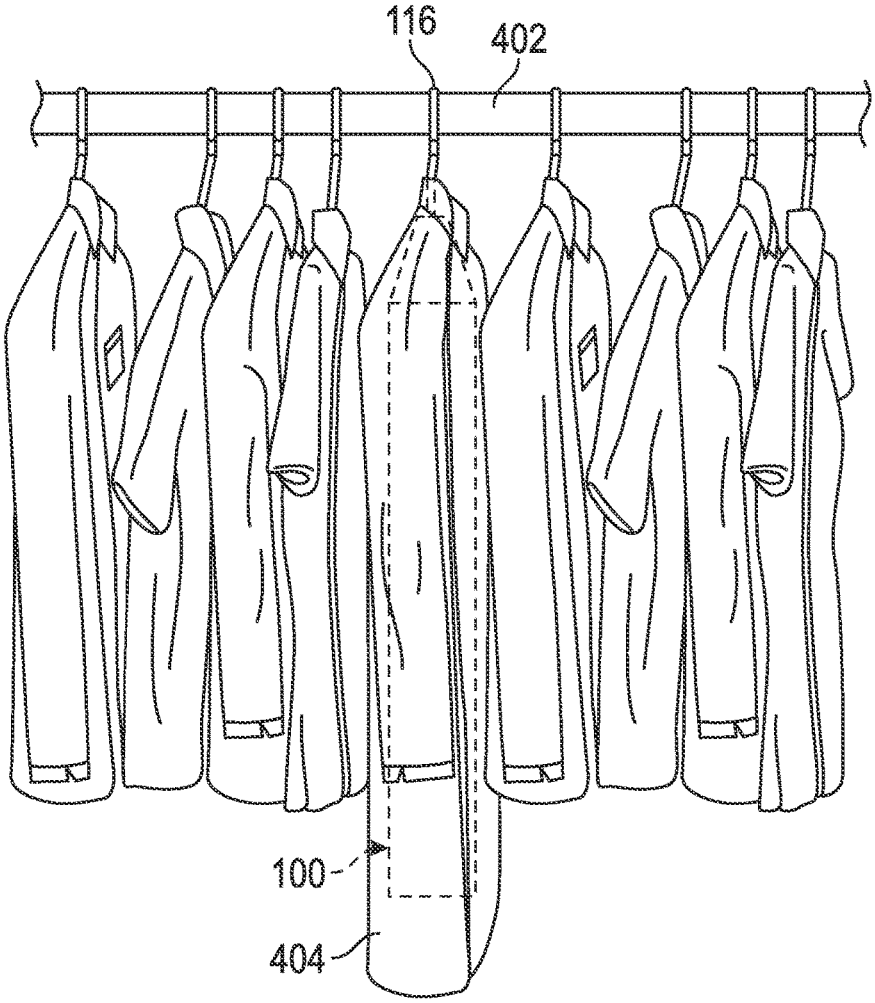
FIG. 4 illustrates an embodiment of a disguised storage system according to the present inventions.

FIG. 4 illustrates a storage system 100 hanging from a clothes rod 402 in a typical closet. The storage system 100 is draped with a man's bathrobe 404 to disguise the storage system 100 among the other clothes and to make it visually blend in. It will now be appreciated that in addition to providing certain level of physical security against unauthorized access, embodiments of my invention also provide security in the form of disguise or camouflage. During thefts or other time-sensitive security breaches, making the location of stored valuables hard to detect and/or may prevent loss of the valuables.

Figure 5:
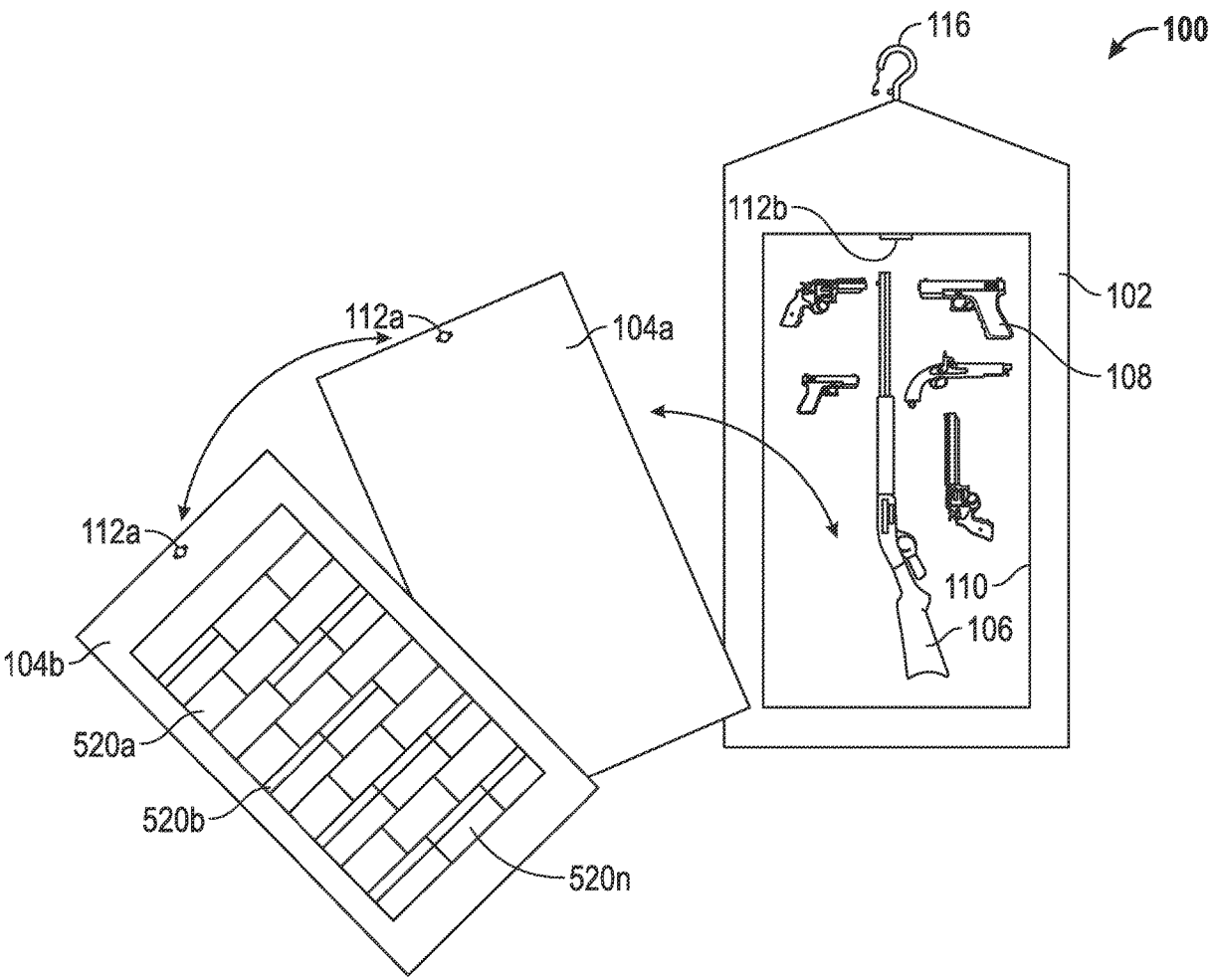
FIG. 5 illustrates another embodiment of storage system.

FIG. 5 illustrates another embodiment of storage system 100 showing a long gun 106 and multiple handguns 108 stored within the cavity with the body 102. Also shown is panel 104 having an outside surface 104*a* and an inside surface 104*b*. Inside surface 104*b* is illustrated to have a plurality of compartments 520*a* through 520*n*. It will be appreciated that each compartment or storage area can be of different size, shape and volume to store a variety of objects and items, such as, but not limited to, jewelry, ammunition, coins, documents and any other valuable or dangerous property. In one embodiment, compartments 520*a* through 520*n* comprise a system of fabric pouches. Other embodiments may comprise individual pouches, compartments or storage devices attachable to the inside surface 104*b* of panel 104.

Figure 6:
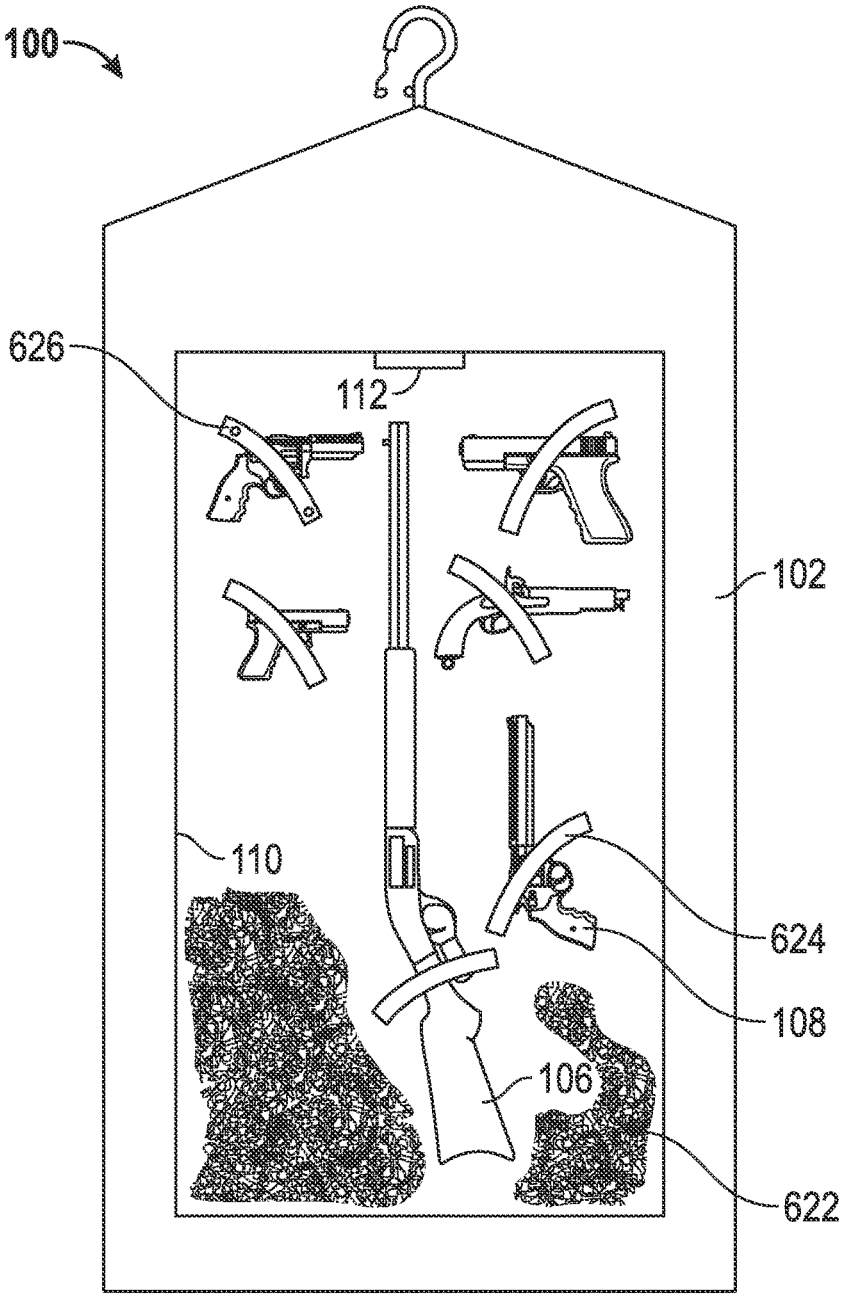
FIG. 6 illustrates a system for securing items within a storage cavity of storage system.

FIG. 6 illustrates one of many possibilities for securing weapons and other items within a storage system 100. The storage area within body 102 may comprise a complementary system of hook and loop materials 622 and 624, such as Velcro®. For example, the storage cavity may be lined with a carpet-like material 622 and hook-type straps 624 may be used to secure items in the storage system 100. An advantage of this type of system is that items can be relocated as desired and items are not restricted to certain predefined locations in the storage system. Alternately, straps 626 may be secured to the storage system through conventional snap systems. This latter type of system does not provide the same freedom of reorganization because of the predetermined snap locations.

Figure 7A:
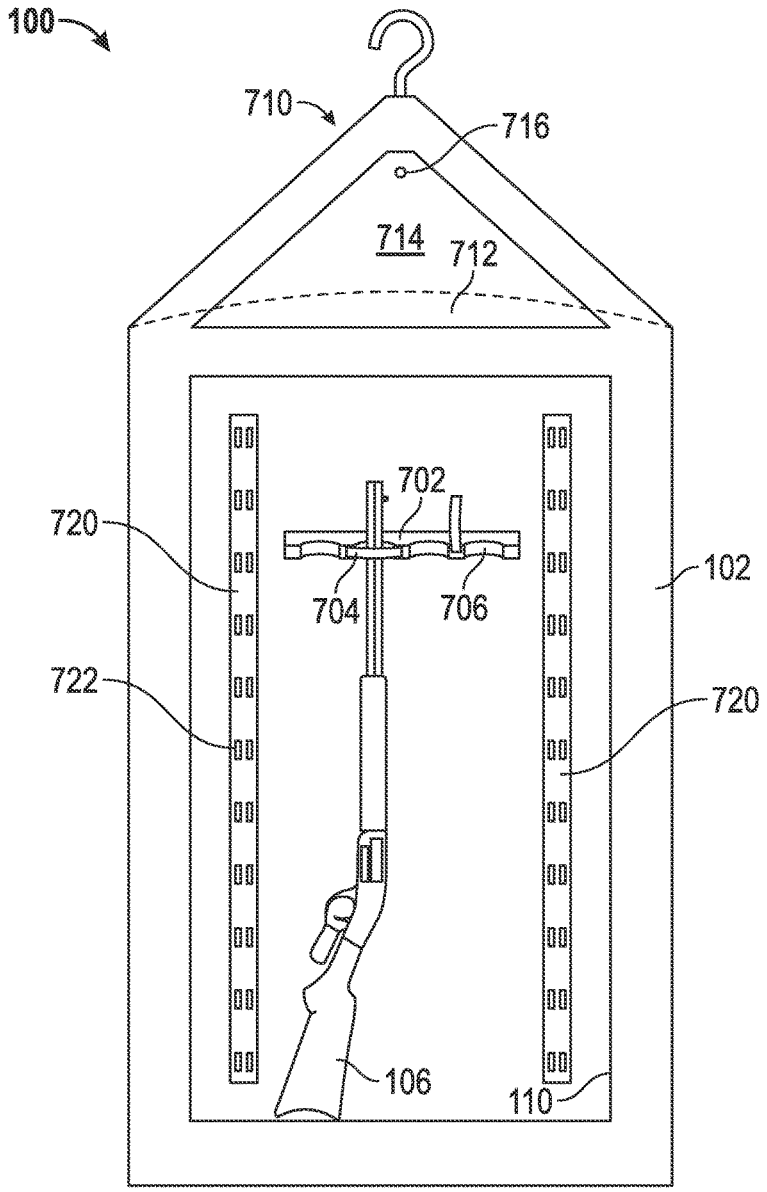
FIGS. 7A-7C illustrate another embodiment of a storage system and another type of system for securing items within a storage cavity of storage system.
Figure 7B:
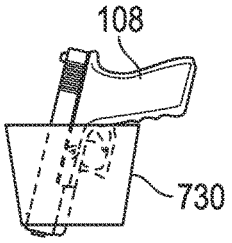

FIG. 7A illustrates yet another embodiment of storage system 100 comprising a body 102 having an opening 110 into a storage volume. Panel or door 104 is not shown in this Figure, but those persons of skill will appreciate that a panel or door as previously discussed may be used with this embodiment. Disposed within the storage volume and mounted to the body 102 is a barrel stock 702 that is configured to receive the barrel portion of a long gun 106 as illustrated. Barrel stock 702 preferably has a retention mechanism 704, such as but not limited to a bar or cord or other physical structure that restrains the barrel with the barrel stock cut out 706. As illustrated in FIG. 7A, the stock of long gun 106 rests on the inner bottom of the cavity and the barrel is secured in barrel stock 702.

Also illustrated in FIG. 7A is additional storage volume 710 that preferably is, but is not require to be, separated from the storage volume accessed by opening 110. This additional storage volume may have a floor 712, which may be considered part of body 102, and may be accessed through a panel or door 714. Door 714 may comprise a lock system 716, similar to the lock systems described for previous embodiments, and such lock system 716 may be keyed similarly or differently to other lock systems on storage system 100. Person of skill will understand the use of "keyed" in this disclosure to refer to actual physical keys, combinations or biometric attributes necessary to operate the lock system. Additional storage volume 710 may be used to securely store jewelry, ammunition, papers and other like valuables.

Figure 7C:
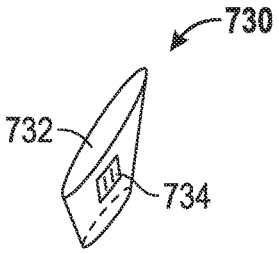

FIG. 7A also illustrates rack system 720 that may be disposed within the main or additional storage volumes and preferably mounted to the body 102. The rack system 702 comprises any of numerous rack systems currently available, and which typically have openings, projections, other structures or combinations of same 722 for hanging or securing items. For example, as shown in FIGS. 78 and 7C a receptacle 730 may have an opening 732 and be adapted to receive an item such as hand gun 108. Receptacle 730 comprises a mounting system 734 for matingly engaging with opening or projections 722 to thereby store handgun 108 within the storage volume. It will be appreciated that a side variety of receptacles 730 can be used with storage system 100, including soft-sided receptacles, such as fabric pouches; leather holsters, and rigid or semi-rigid boxes, that may or may not be separately lockable.

Figure 8A:
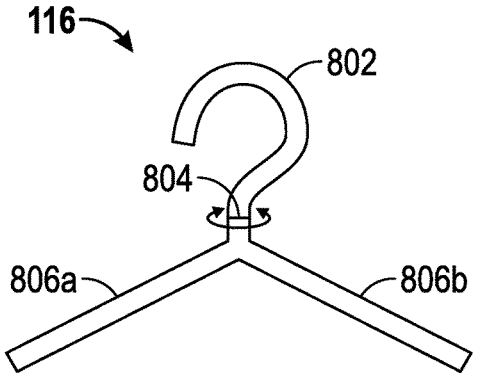
FIGS. 8A-8C illustrate possible embodiments of an attachment mechanism for a storage system.
Figure 8B:
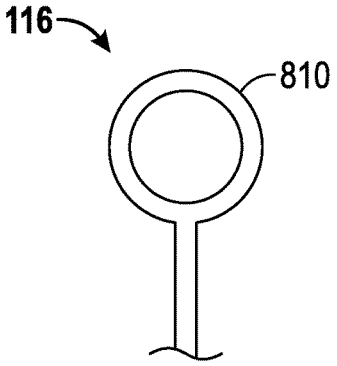
Figure 8C:
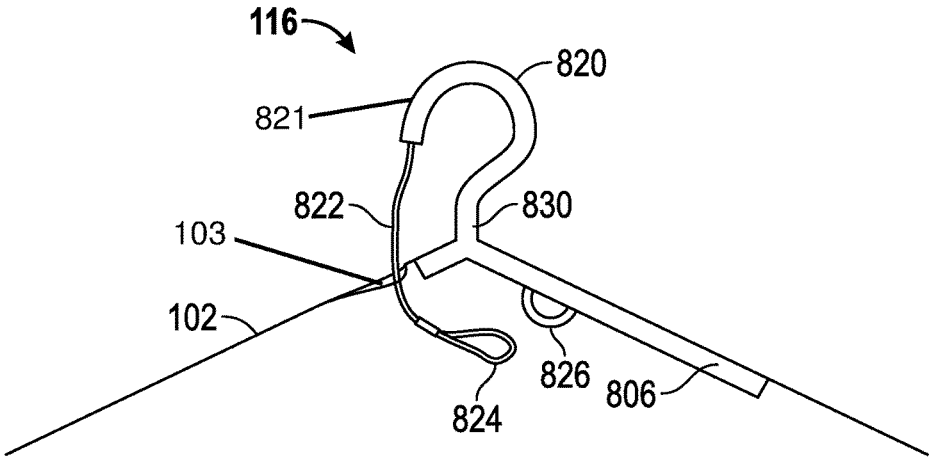

Turning to FIGS. 8A, 8B and 8C, several different embodiments of attachment component 116 are illustrated. FIG. 8A illustrates an open attachment component 802 that does lock to the item from which it hangs. It will be appreciated that one of the many benefits of the storage system 100 is that the owner/user may select the level of security that is desired or required. By selecting an open attachment component 802, the storage system 100 may be easily and rapidly hung and easily removed from, for example, a conventional clothes rod. In addition, attachment component 802 may additionally comprise a swivel joint 804 that allows the body 102 to rotate relative to attachment component 116. Rotation in this manner allows easy access to panel 104 (the storage volume) for disposal and retrieval of items. Also shown are mounting flanges 806*a* and 806*b* configured to engage body 102 and spread the weight carried by attachment component 116 across a wider area of the body 102.

FIG. 8B illustrates a closed attachment component 116. This type of attachment component 116 may be preferred when the storage system 100 is suspended in a closet from a conventional clothes rod. Such clothes rods are typically removable, and once removed, the clothes rod may be passed through the opening formed by closed attachment component 16. Once the clothes is returned to position, the storage system 100 is secured to the clothes rod and may not be easily removed therefrom without the clothes rod once again being removed. Attachment component 116 may or may not comprise mounting flange(s) as required or desired.

FIG. 8C illustrates a lockable attachment component 820 comprising a flexible member 822, such as wire or chain secured to an end of a curved portion 821 of the attachment component 820 as illustrated. The other end of flexible member 822 has loop or attachment portion 824 formed therein or thereon. Adjacent attachment component 820 in body 102 is an opening 103 configured to allow the attachment portion 824 to pass there through into an interior volume of the body 102. As illustrated in FIG. 8C attachment component 820 has a staple 826 associated therewith and configured such that a conventional keyed or combination lock may secure attachment portion 824 to staple 826, thereby securing storage system 100 to the structure from which it is suspended during use. It will be appreciated that so long as staple 826 is located in an area to which access is controlled, such as by panel 104, a simple bolt, clasp or other similar device may be used to securely join attachment portion 824 to staple 826. Alternately, attachment portion 824 may be locked to the shank portion 830 of attachment component 116, and need not pass through an opening 103 in the body 102.

Figure 9:
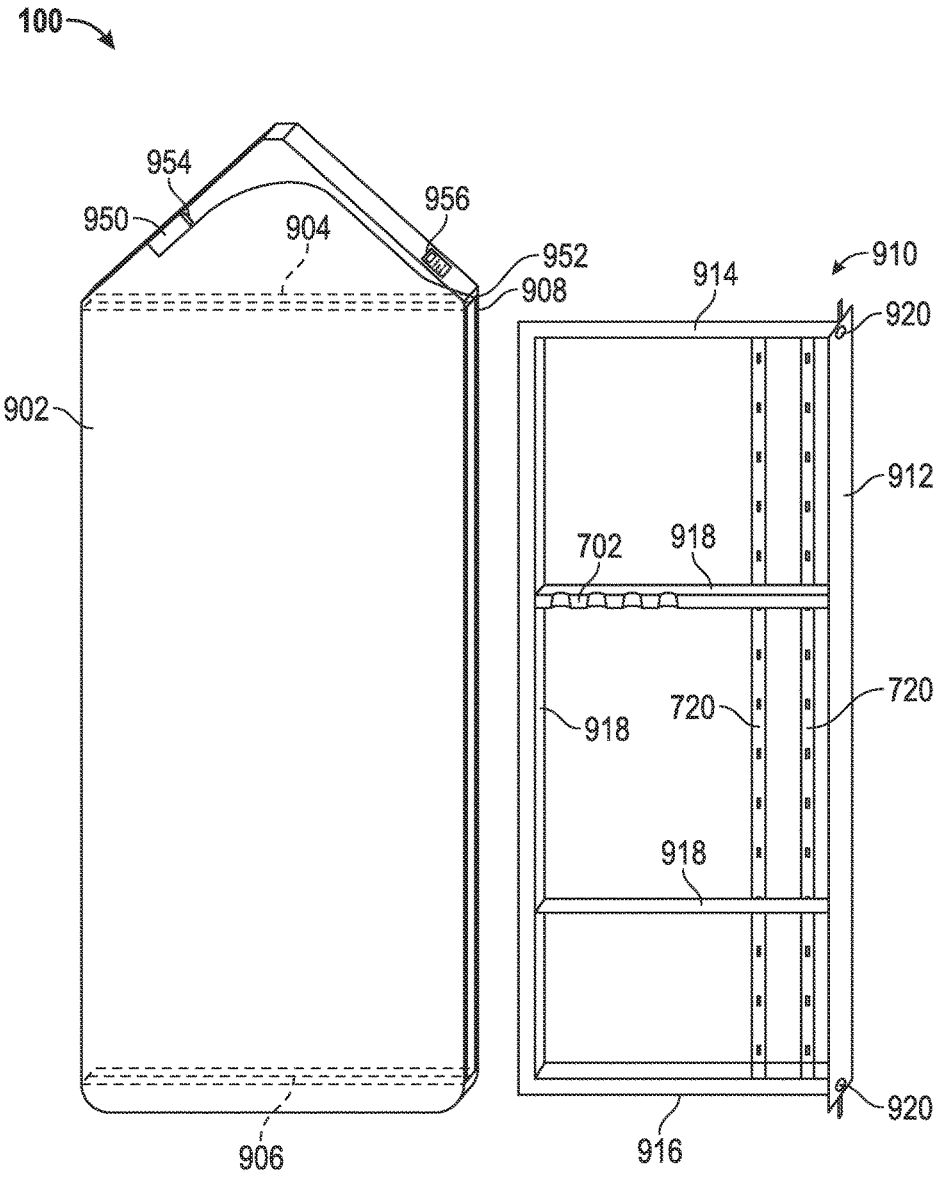
FIG. 9 illustrates yet another embodiment of a storage system.

FIG. 9 illustrates yet another embodiment of storage system 100 comprising a three-dimensional body 902 defining an interior volume. Disposed within the interior volume are track or guide systems 904 and 906. One transverse side of body 902 (i.e., a side defining the depth) has an opening 908 therein providing access to the interior volume. The embodiment of FIG. 9 further comprises a skeleton frame 910 having an end panel 912 that couples with the opening 908 to close off access to the interior volume. Skeleton frame 910 comprises rails 914 and 916, which operable engage with tracks 904 and 906, respectively, to receive and guide skeleton frame 910 into the interior volume. Skeleton frame 910 may comprise additional support elements 918 to provide necessary structural rigidity support for time that may be secured to the skeleton frame 910 for storage within the interior volume of body 902.

Skeleton frame 910 may be completely removable from body 902 or may be only partially removable from body 902. In a preferred form, skeleton 910 is completely removable for easy loading with items to be stored. Once the items to be stored are loaded on the skeleton 910, the skeleton may then be inserted along tracks 904 and 906 into the body 902. Panel 912 and adjacent portions of 902 may have one or more lock systems 920 for lockably securing skeleton 910 within the body 902. Alternately, the lock system 920 may be disposed on a distal end of skeleton 902 and a distal end or side of body 902 (i.e., opposite opening 908).

It will be appreciated that skeleton 910 may be configured with any of the foregoing systems for securing or holding items, such as but not limited to barrel stock 702, or rack systems 720, hook and loop systems.

Also shown in FIG. 9 is an alarm system 950, which may comprise magnetic or other contacts 952 between the body 902 and the skeleton 910 or panel 912. Such alarm system 950 may be configured to announce, such as by klaxon, unauthorized access to the interior volume of body 902, such as by unauthorized removable of skeleton 910. The alarm 950 may also be configured to announce unauthorized removal of storage system 100 from the device upon which it is hung, as illustrated a 954. The alarm system 950 may also comprise an arming/disarming panel 956 located on an exterior surface of body 902. The alarm system 950 may also provide or control the locking, system functionality required by the embodiment.

Figure 10:
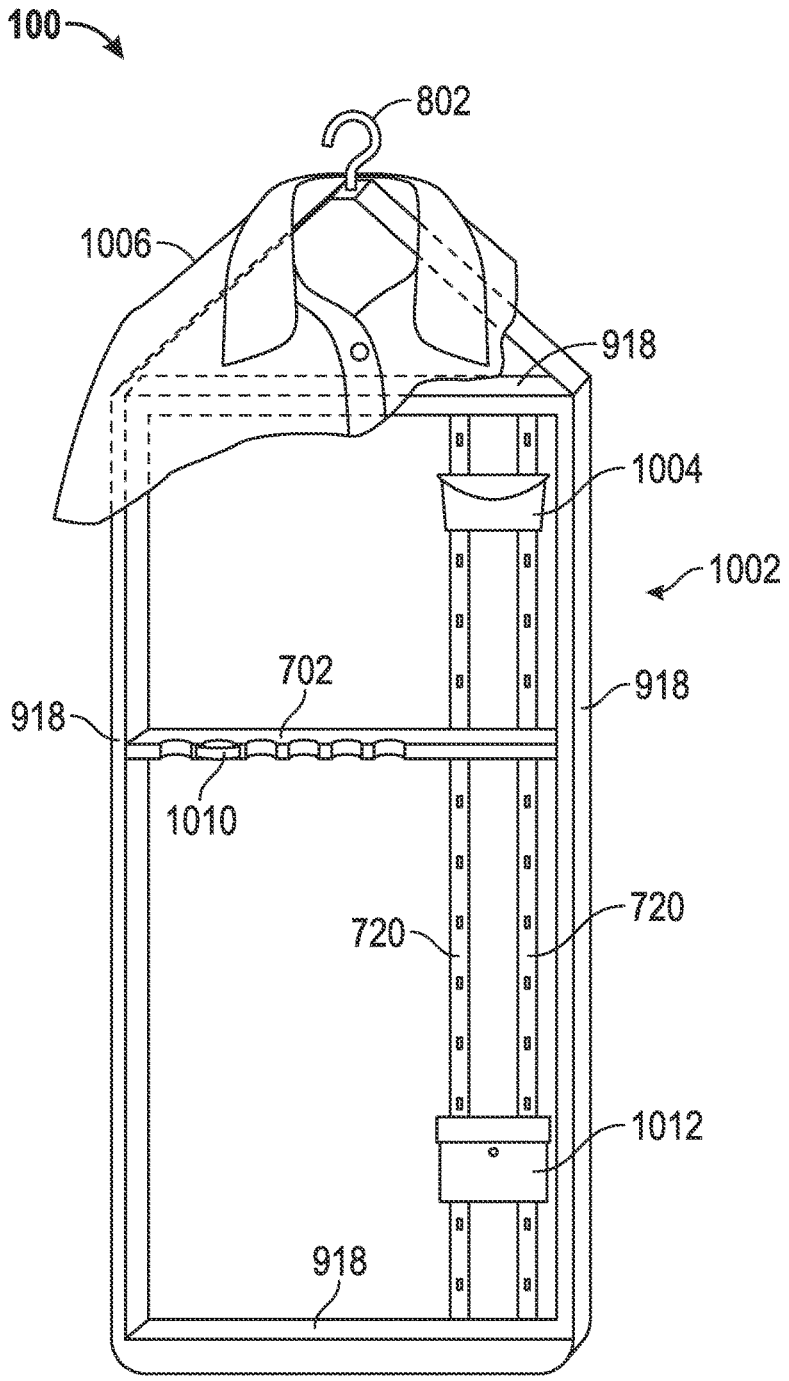
FIG. 10 illustrates a still further embodiment of a storage system.

FIG. 10 illustrates a still further embodiment of storage system 100. This embodiment is comprises a skeleton frame 1002 and no body. The skeleton 1002, similarly to skeleton 910 of FIG. 9, comprises structural elements 918 that cooperate to form the skeleton 1002 from which items may be secured or attached. For example, skeleton 1002 may further comprise a barrel stock 702, and/or rack systems 720, and/or other structural elements and surfaces to which items may be secured. As illustrated in FIG. 10 a pouch or container 1004 may be secured to the skeleton 1002 for storing items. The skeleton 1002 may be disguised by covering the skeleton 1002 with a clothing item 1006 and hanging the storage system 100 from a clothes rod with other clothing items adjacent, such as illustrated in FIG. 4. It will be appreciated that this embodiment provides visual security through disguise or camouflage, but not through physical security.

Alternately, a level of physical security can be provided by the embodiment illustrated in FIG. 10, such as by providing barrel stock 702 with a locking retention mechanism 1010. Also, a lockable box 1012 may be secured to rack system 720 with theft resistant screws or other secure attachments means.

Figure 11:
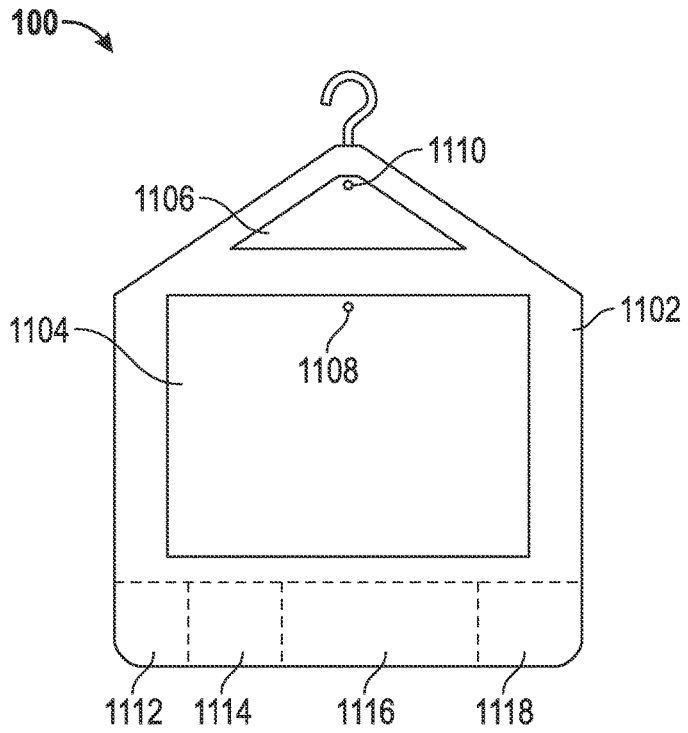
FIG. 11 illustrates another embodiment of a storage system.

FIG. 1 illustrates another embodiment of a storage system 100 comprising a body 1102 that is shorter than the embodiment 100 shown in FIG. 1. The embodiment 100 shown in FIG. 11 comprises a main panel 1104 providing and restricting access to a main interior storage volume and a secondary panel 1106 providing and restricting access to a secondary storage volume. The main panel 1104 and the secondary panel 1106 may comprise a lock system 1108 and 1110, such as those described for the embodiments above. FIG. 11 also illustrates internal compartments 1112 through 1118 constructed within the main interior volume. In other words access to internal compartments 1112 through 1118 can be restricted by main panel 1104.

Figure 12:
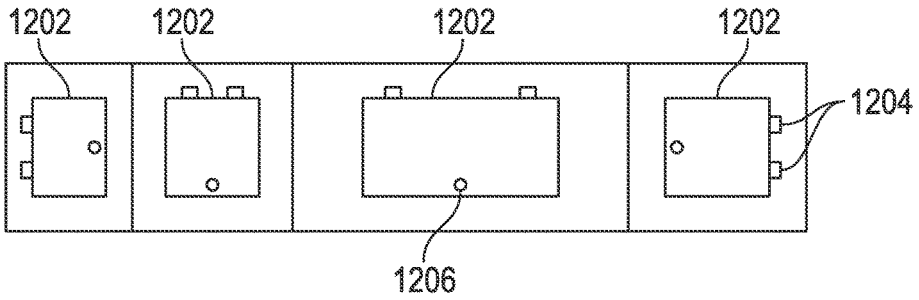
FIG. 12 illustrates internal compartments in a storage system.

FIG. 12 illustrates a plan view of internal compartments 1112 through 1118 and shows that one or more of the compartments may have additional security features such as a door or panel 1202 and/or hinges 1204 and/or lock system 1206.

It will be appreciated that the embodiment illustrated in FIGS. 11 and 12 are suitable for secure storage of smaller items such as jewelry, papers and other valuables and may be effectively disguised by covering with a shirt or other clothing item and hanging the storage system 100 in a closet.

Having the benefit of this disclosure, those persons having skill in the art will now understand that each feature described with reference to a particular embodiment or figure can be used or combined with one or more features described for another embodiment or figure to create a still further embodiment or embodiments that practice or encompass the inventions taught herein. For example, an alarm system may be used with any embodiment of my inventions. In addition, any embodiment may utilize one or all of the storage devices, such as hook and loop, barrel stocks, racks, soft or rigid containers and the like. Also, embodiments may be camouflaged or disguised with articles of clothing, accessories for clothing, such as laundry bags, hanging suitcases, or any other thing or material that will disguise or camouflage the storage system in its environment.

The inventions have been described in the context of preferred and other embodiments and not every embodiment of the inventions has been described. Discussion of singular elements can include plural elements and vice-versa. Obvious modifications and alterations to the described embodiments are now readily apparent to those of skill in the art. The disclosed and undisclosed embodiments are not intended to limit or restrict the scope or applicability of the invention conceived of by the Applicants, but rather, in conformity with the patent laws, I intend to fully protect all such modifications and improvements that come within the scope or range of equivalent of the following claims.

What I claim is:

1. A storage system, comprising:

a body having at least one cavity therein configured to house one or more items;

an opening defined by the body and providing access to the cavity;

a panel configured to mate with the opening and prevent access to the cavity when the panel is positioned in the opening;

a first lock system operable between the body and the panel and providing a locked condition in which the panel is locked to the body preventing removal of the panel and access to the cavity, and an unlocked condition in which the panel is not locked to the body allowing access to the cavity;

an attachment mechanism coupled to a first end of the body and comprising a shank portion extending away from the body and a curved portion, the shank and curved portions configured to visually resemble a coat hanger so that the attachment mechanism is substantially disguised as a coat hanger when the system is suspended among coat hangers;

a hole in or adjacent the first end of the body;

an attachment mechanism lock system comprising first, second and third portions, the first portion secured to an end of the curved portion of the attachment mechanism, the third portion comprising a component disposed in an area of the cavity to which access is controlled by the panel, and the second portion configured to pass through the hole in the body to securely engage the third portion, the attachment mechanism lock system configured to lockably secure the storage system to a structure from which the system is suspended; and the body configured to be covered by an article of clothing such that if suspended among hanging clothes, the system is substantially disguised as clothing suspended by a coat hanger.

2. The storage system of claim 1, wherein the attachment mechanism comprises an open hook structure and allows easy removal of the storage system from a structure from which it is suspended when the second portion of the attachment mechanism lock system is not securely engaged to the third portion.

3. The storage system of claim 1, further comprising a system within the at least one cavity configured to store a combination of long guns and short guns.

4. The storage system of claim 1, further comprising a second cavity within the body configured to house one or more items, a second opening defined by the body and providing access to the second cavity; a second panel configured to mate with the second opening and prevent access to the second cavity; and a second lock system configured to lockably secure the second panel to the second opening.

5. The storage system of claim 1, further comprising a plurality of storage volumes within the at least one cavity.

6. The storage system of claim 5, wherein the plurality of storage volumes are selected from the group consisting of: open compartments; closed compartments, locking compartments; and any combination of open, closed and locking compartments.

7. The storage system of claim 1, further comprising an alarm system configured to warn of unauthorized access to the storage system.

8. The storage system of claim 7, wherein the alarm system is configured to audibly warn against unauthorized access to the at least one cavity.

9. The storage system of claim 1, further comprising:

an alarm system configured to audibly warn against unauthorized access to the at least one cavity or disabling of the attachment mechanism lock system, or both.

10. The storage system of claim 4, wherein the second lock system is keyed differently than the first lock system.

11. A storage system, comprising:

a body having at least one cavity configured to house one or more items;

an opening in the body providing access to the at least one cavity;

a panel configured to prevent access to the at least one cavity through the opening;

a first lock system having a first key and operable between the body and the panel providing a locked condition in which the panel is locked to the body preventing access to the at least one cavity, and an unlocked condition allowing access to the at least one cavity;

a hook coupled to the body comprising a curved portion and configured to suspend the system;

an anti-removal device comprising a flexible member, a securing structure and an attachment portion, the flexible member fixedly secured to an end of the curved portion of the hook, the securing structure disposed in an area of the cavity having access controlled by the first lock system;

a hole in the body configured to pass the attachment portion of the anti-removal device there through to securely engage the third portion;

the anti-removal device configured to secure the storage system to a structure from which the storage system is suspended when the attachment portion is secured to the securing structure and the first lock is in the locked condition.

12. The storage system of claim 11, further comprising a system within the cavity configured to store a combination of long guns and short guns.

13. The storage system of claim 11, further comprising a second cavity within the body configured to house one or more items, a second opening defined by the body and providing access to the second cavity; a second panel configured to prevent access to the second cavity; and a third lock system configured to secure the second panel to the second opening.

14. The storage system of claim 13, wherein the third lock system uses the first key.

15. The storage system of claim 14, further comprising a plurality of storage volumes within the at least one or second cavity.

16. The storage system of claim 15, wherein the plurality of storage volumes are selected from the group consisting of: open compartments; closed compartments, locking compartments; and any combination of open, closed and locking compartments.

17. The storage system of claim 11, wherein the body configured to be covered by an article of clothing such that when suspended among hanging clothes, the storage system is substantially disguised as clothing.

18. The storage system of claim 11, wherein the securing structure is a staple.

19. The storage system of claim 18, further comprising a lock securing the attachment portion of the anti-removal device to the staple.

20. The storage system of claim 19, wherein the lock securely engaging the attachment portion and staple of the anti-removal device is keyed differently than the first lock system.

* * * * *